US006225885B1

(12) United States Patent
Lin

(10) Patent No.: US 6,225,885 B1
(45) Date of Patent: May 1, 2001

(54) SWITCH DEVICE

(76) Inventor: Kuo Jung Lin, P.O. Box 1032, Tainan (TW)

( * ) Notice: Subject to any disclaimer, the term of this patent is extended or adjusted under 35 U.S.C. 154(b) by 0 days.

(21) Appl. No.: 09/227,726

(22) Filed: Jan. 8, 1999

(51) Int. Cl.[7] ..... H01H 9/00
(52) U.S. Cl. ..... 335/206; 335/205; 335/207
(58) Field of Search ..... 335/205–207; 446/130

(56) References Cited

U.S. PATENT DOCUMENTS 4,544,903 * 10/1985 Grant ..... 335/205

* cited by examiner

*Primary Examiner*—Ramon M. Barrera
(74) *Attorney, Agent, or Firm*—Bacon & Thomas, PLLC

(57) ABSTRACT

A switch device includes two contactors. Each contactor respectively includes at least two conductors, a magnet, and a coil spring. The conductors are connected to a power source via a powered electronic circuit. The circuit is designed to be in a normally open or closed initial condition. The magnet is directly or indirectly connected to the conductors. The coil spring is directly or indirectly located between the conductors and the magnet. The conductors change their normally open or closed condition into a temporarily closed or open condition to turn on or off the switch device when the contacts move near enough to permit magnets to interact magnetically. The coil spring forces the conductors to recover their original normally open or closed condition when the magnets cease to interact magnetically.

3 Claims, 13 Drawing Sheets

SWITCH DEVICE

BACKGROUND OF THE INVENTION

This invention relates to a switch device, and particularly to one consisting of two contactors having two conductors in a normally open or closed condition, the two conductors being changed into a temporarily closed or open condition so as to turn on or off the switch device for starting movement of two things provided with the two contactors.

Communication and contact are a crucial element in social activities, and every one should pay attention to the way and etiquette of communication and contact with other people. Especially, young children should be trained in these matters from an early age for leading and correcting social tendency and behavior. Toy dolls delightful to children are designed and manufactured independently, and are made to exhibit various movements such as blinking, extending hands, kicking with feet, or speaking out words, and so forth. But such movements are always done by a single doll, with no corresponding mutual talking or action between two dolls. There are no such two dolls capable of talking to each other, singing, or even kissing or expressing lovable action.

SUMMARY OF THE INVENTION

This invention has been devised, depending on two separate things, which moves nearer each other for contacting each other and making corresponding action or movement or sounds or talk. Thus children may play and learn from those dolls how to talk, to act or to sing, by arousing their curiosity.

One object of the invention is to offer a switch device consisting of two contactors respectively containing two strip conductors in an initial normally open or closed condition.

Another object of the invention is to offer a switch device which makes it possible to control two things such as dolls in making action, movement, singing, talking, etc. to enhance interest.

BRIEF DESCRIPTION OF DRAWINGS

This invention will be better understood by referring to the accompanying drawings, wherein.

DETAILED DESCRIPTION OF THE PREFERRED EMBODIMENTS

Figure 1:
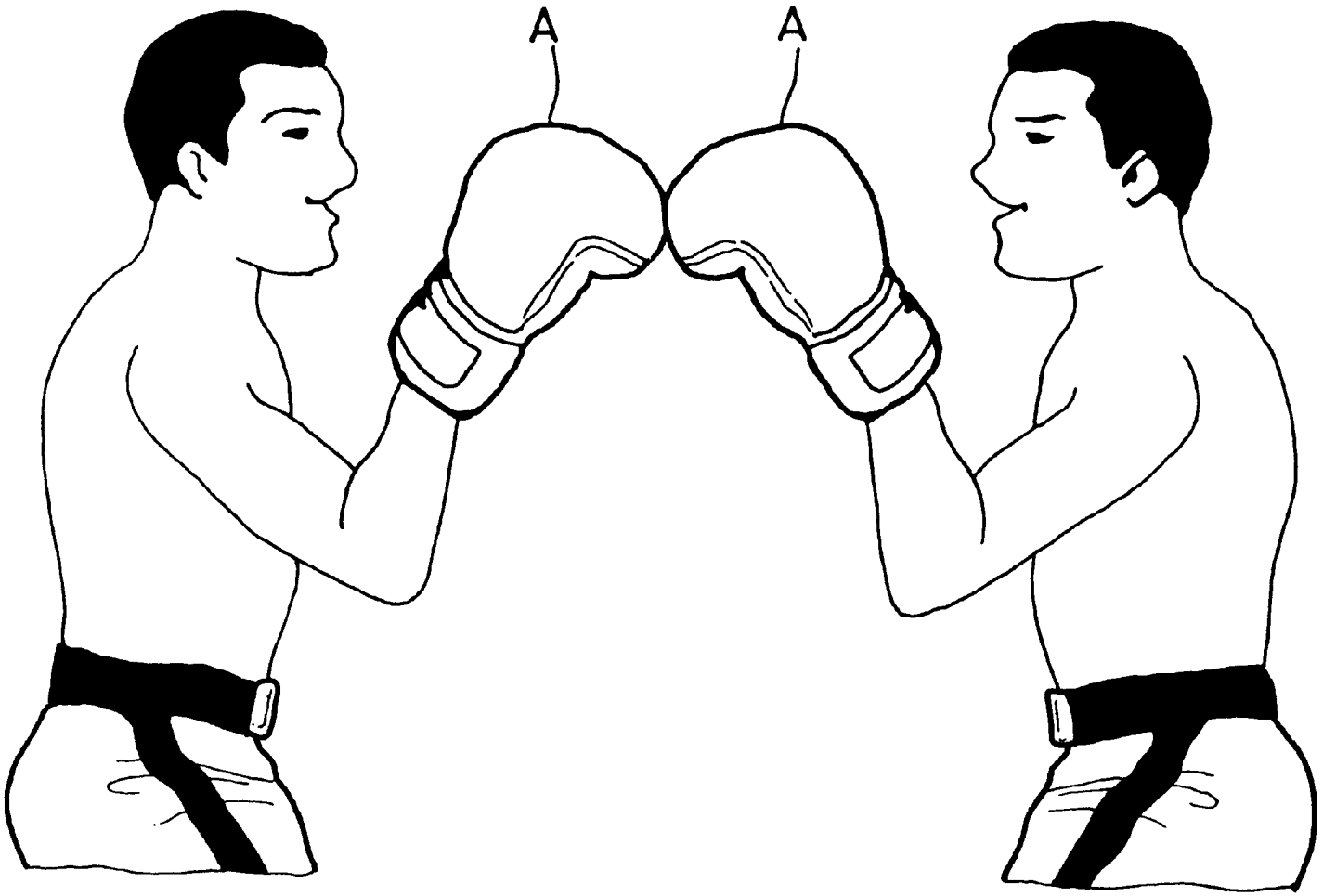
FIG. 1 is a perspective view of a first embodiment of a switch device applied to a thing in the present invention.

A first embodiment of a switch device of the present invention, as shown in FIG. 1, is applied in two boxing gloves (a thing), which are located to contact with each other before the two boxers may also exchange dialogue, using threatening words or praise, but the exchange of dialogue is not included in the present invention.

Figure 2:
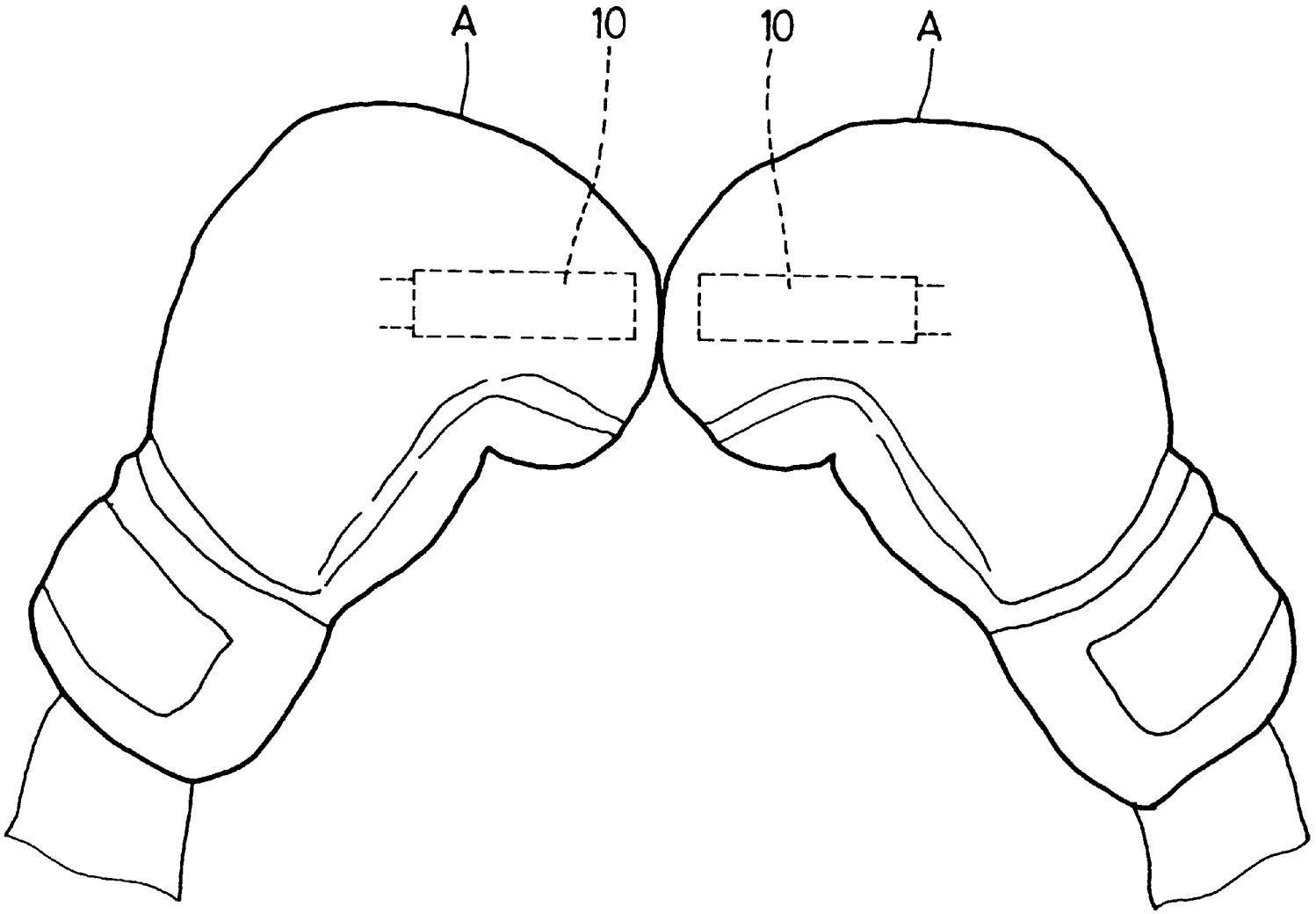
FIG. 2 is a magnified view of FIG. 1.

As shown in FIG. 2, a contactor 10 is provided inside each boxing glove A, and the two contactors 10 will be turned on to let a sound device contained in the two boxers' bodies produce verbal words as along as the two contactors move nearer each other enough to a preset position. The verbal words produced by the sound device may be set in advance, and the time needed also has to be preset. But of course, the verbal words can coordinate with physical movements to enhance its effect. These matters are riot included in the present invention.

Figure 3:
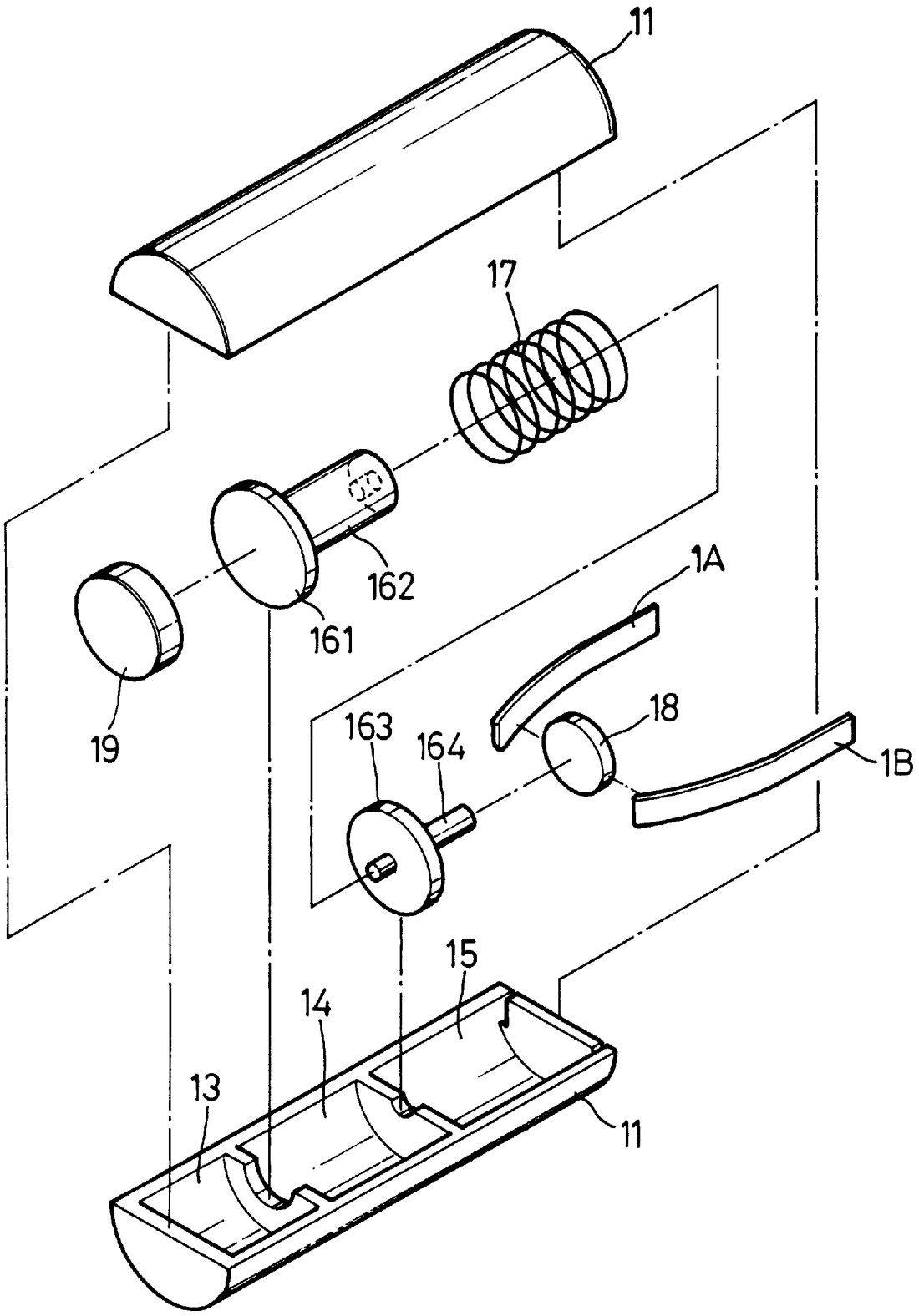
FIG. 3 is an exploded perspective view of the first embodiment of the switch device of the present invention.
Figure 4:
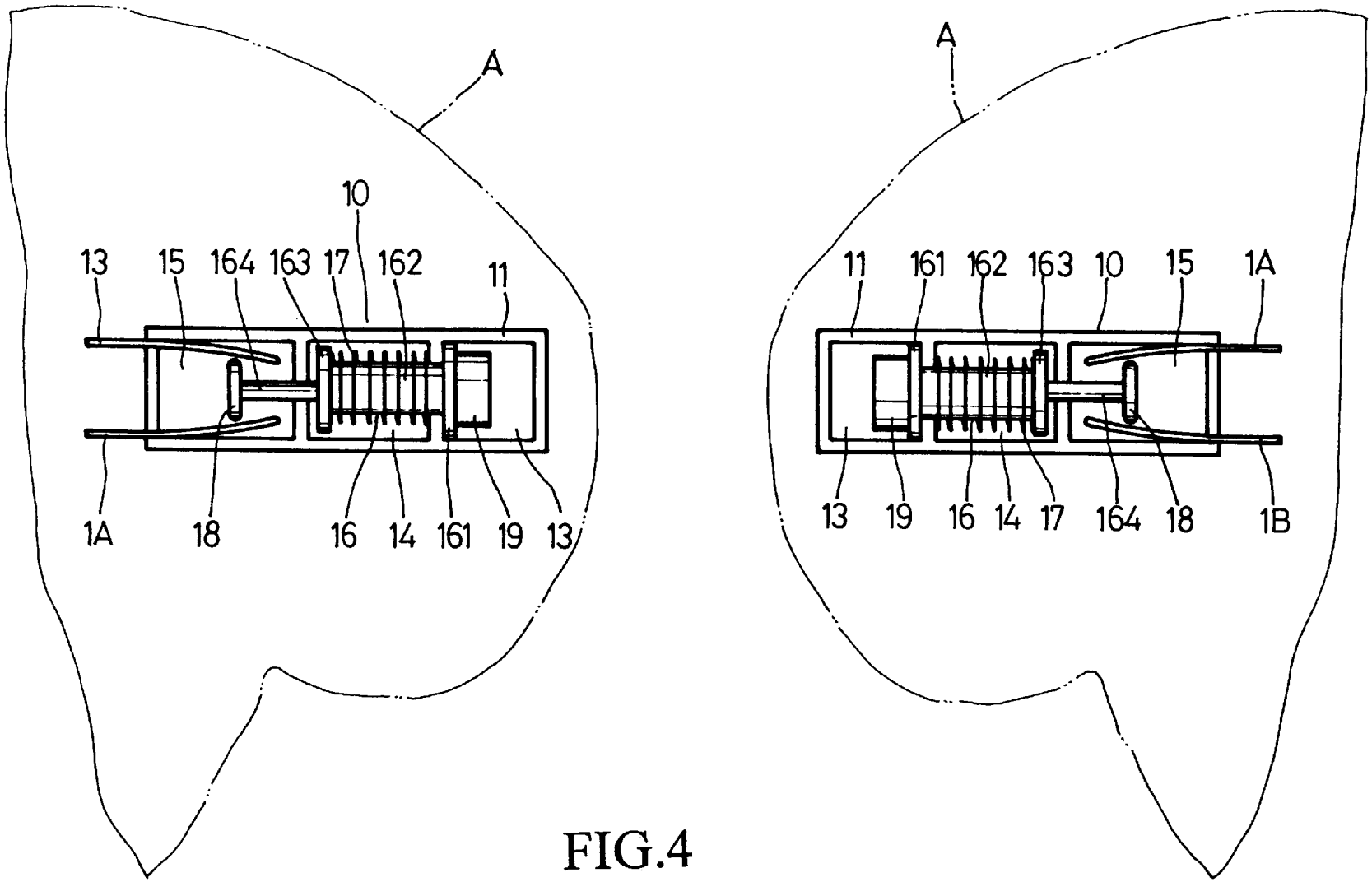
FIG. 4 is a cross-sectional view of the first embodiment of the switch device of the present invention.

Two of the contactors 10, as shown in FIGS. 3 and 4, constitute the switch device according to the present invention, including a housing 11 consisting of two halves and having its interior divided into a front, an intermediate and a rear space 13, 14 and 15 by means of separating walls. The first separating wall between the front space 13 and the intermediate space 14 has a first hole for communicating the two space 13, 14. There is also a second hole in the second separating wall between the intermediate space 14 and the rear space 15.

Each contactor 10 further has a movable member 16 consisting of a head 161 and a shaft 162 formed integrally with the head 161, and a head 163 and a shaft 164 formed integrally with the head 163. The head 161 is located in the front space 13, with the shaft 162 passing through the first hole and extending in the intermediate space 14. A coil spring 17 is provided to fit around the shaft 162, with one end resting on the first separating wall. The head 163 is located just behind the rear end of the shaft 162, with the rear end of the coil spring 17 resting on the head 163. The shaft 164 passes through the second hole of the second separating wall between the intermediate and the rear space 14 and 15 and extends into the rear space 15. A disc conductor 18 (preferably made of a metal) is provided and fixed with the rear end of the shaft 164. Further, a magnet 19 is fixed with a front surface of the head 161.

Each contactor 10 further includes two strip conductors 1A, 1B, pinched between the walls of the housing 11 with one end extending out of the housing 11, and the other end extending in the rear space 15 and bent a little beyond the disc conductor 18. In the normal condition, the two contactors 10 are not located in the contact position, but are elastically pushed by the coil springs 17. So each contactor 10 is in the normally off condition as shown in FIG. 4, with the disc conductor 18 being separated from the two strip conductors 1A, 1B.

Figure 5:
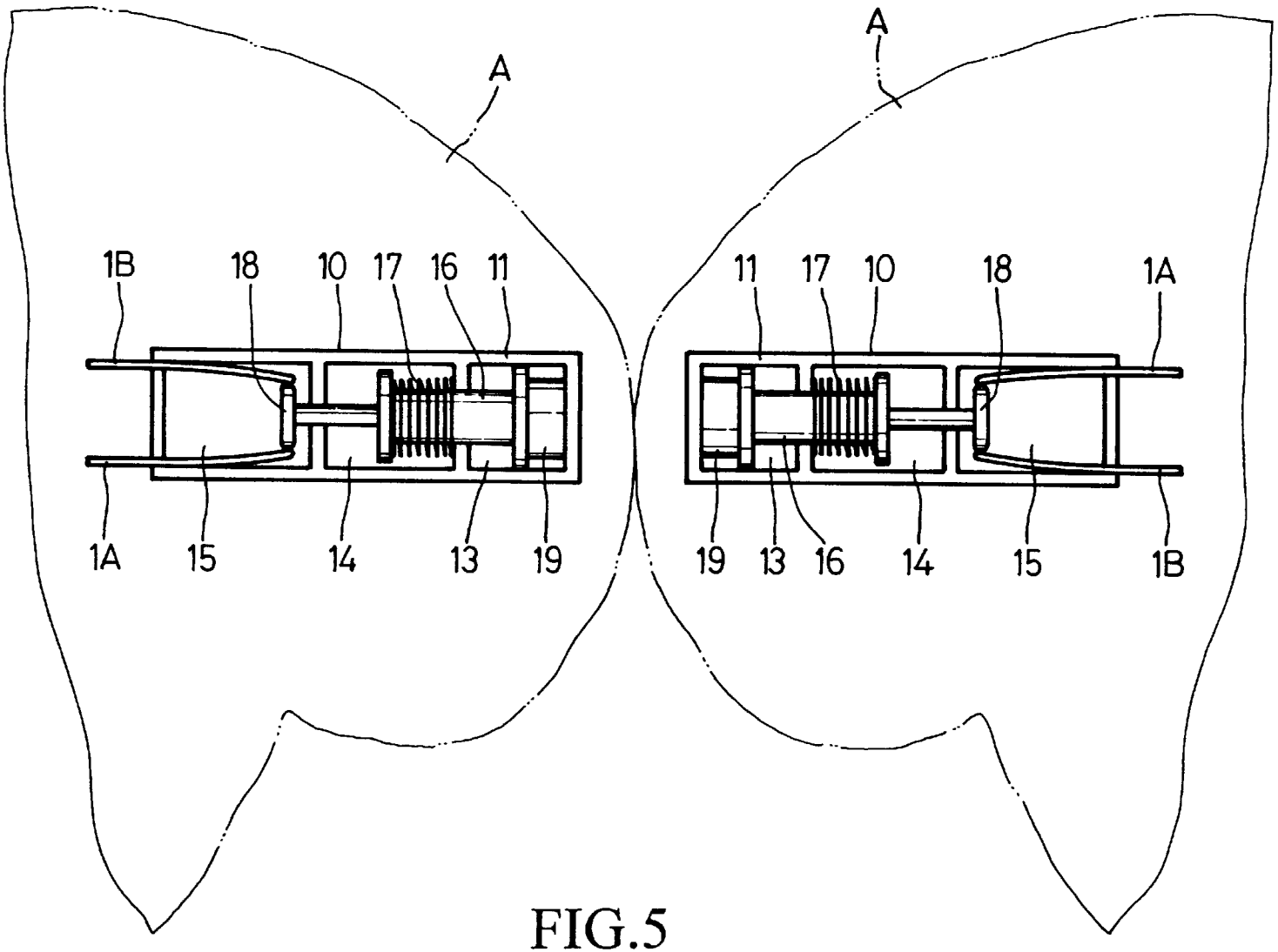
FIG. 5 is a cross-sectional view of the first embodiment of a switch device turned on in the present invention.

Next, as shown in FIG. 5, if the two contactors 10 move nearer each other to a preset contact position (wherein the two magnets 18 in the two contactors 10 may Produce mutual a magnetic attractive force), the two movable members 16 of the two contactors 10 move forward axially at the same time against the two coil springs 17 by means of attraction of the different poles of the two magnets 19, forcing the two strip conductors 1A, 1B of both the contactors 10 to contact the disc conductor 18 to turn on the switch device. The closed circuit causes the boxing gloves to sound or speak out and move physically for once, with the contactors 10 functioning as electrical terminals. The two things (such as boxing gloves, dolls. etc.) may sound, speak and move synchronously by concurrent turning-on action of the two contactors 10. Further, a delay function may enable the subsequent action to continue, so turning-on once may cause a whole set of preset sounds or physical movement finish, despite the two contactors 10 having already separated to turn off the switch device. The two contactors 10 recover the normally off position shown in FIG. 4 when they move away from the preset contact position and the two magnets 19 are no longer able to attract each other. Meanwhile, dialogue and action of the two things may be kept on to the end.

Figure 6:
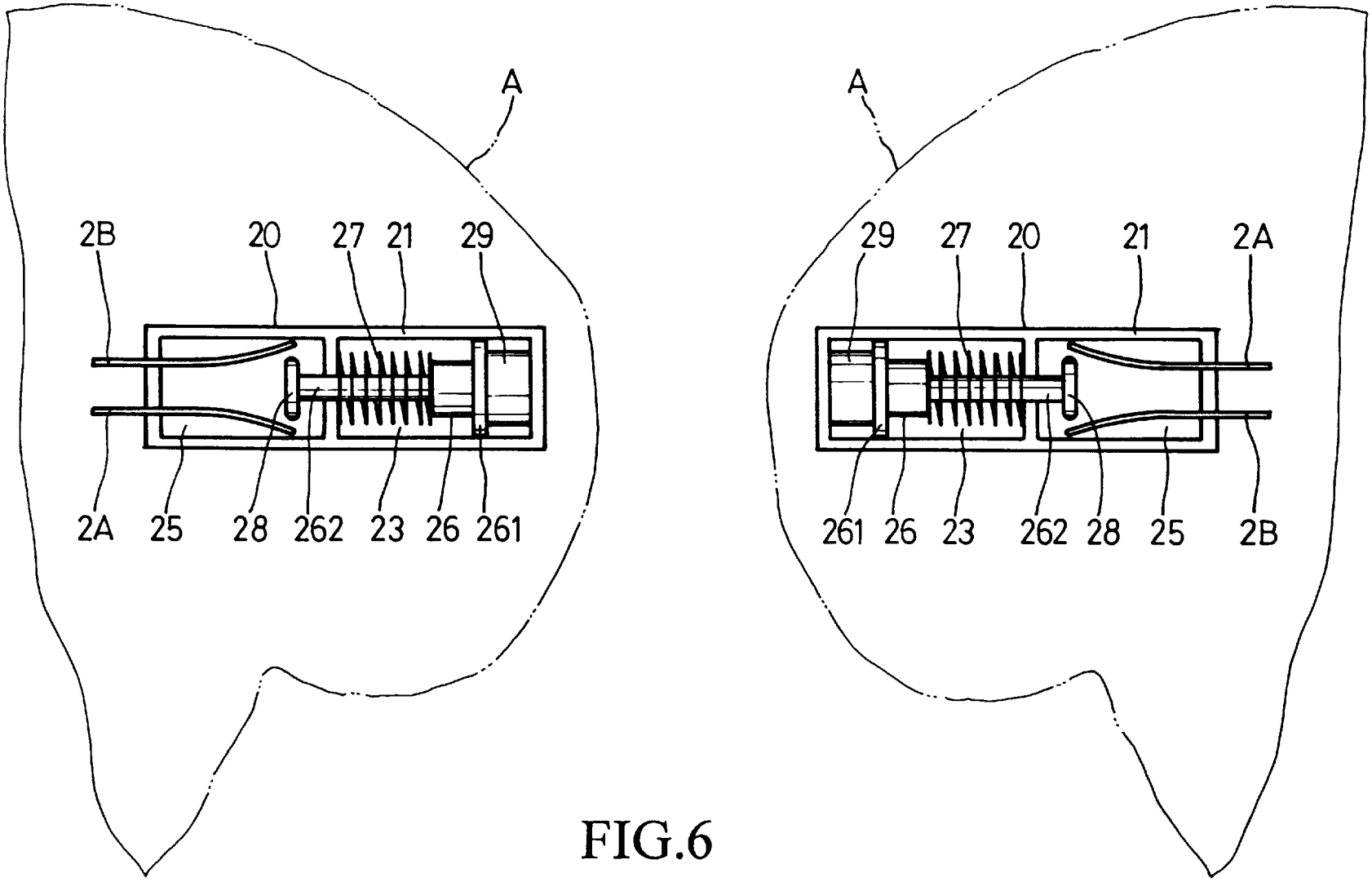
FIG. 6 is a cross-sectional view of a second embodiment of a switch device of the present invention.

Further, a switch device May not be limited -to the structure shown in FIGS. 3, 4 and 5. FIG. 6 shows a second embodiment of a switch device in the present invention including two contactors 20 respectively consisting of a housing 21 made up of two halves, a movable member 26, a coil spring 27, a disc conductors 28, a magnet 29, and two strip conductors 2A, 2B. But the interior of the housing 21 is divided into two spaces, a front one 23, a rear one 25, by a separating wall. The movable member 26 consists of a head 261, and a shaft 262 formed integral with the head 261. The magnet 29 is fixed firmly on a front surface of the head 261, and the coil spring 27 is fitted around the shaft 262, with one end resting on the head 261 and with the other end resting on the separating wall of the spaces 23, 25. The rear end of the shaft 262 passes through a hole of the separating wall to extend in the rear space 25 and then is fixed firmly with the disc conductor 28. The two strip conductors 2A, 2B are pinched in the housing 21 and their r outer ends extend out of the housing 21, with their inner bent ends located near the two sides of the disc conductor 28, as shown in FIG. 6, the two bent ends being in a separated condition relative to the disc conductor 28.

Figure 7:
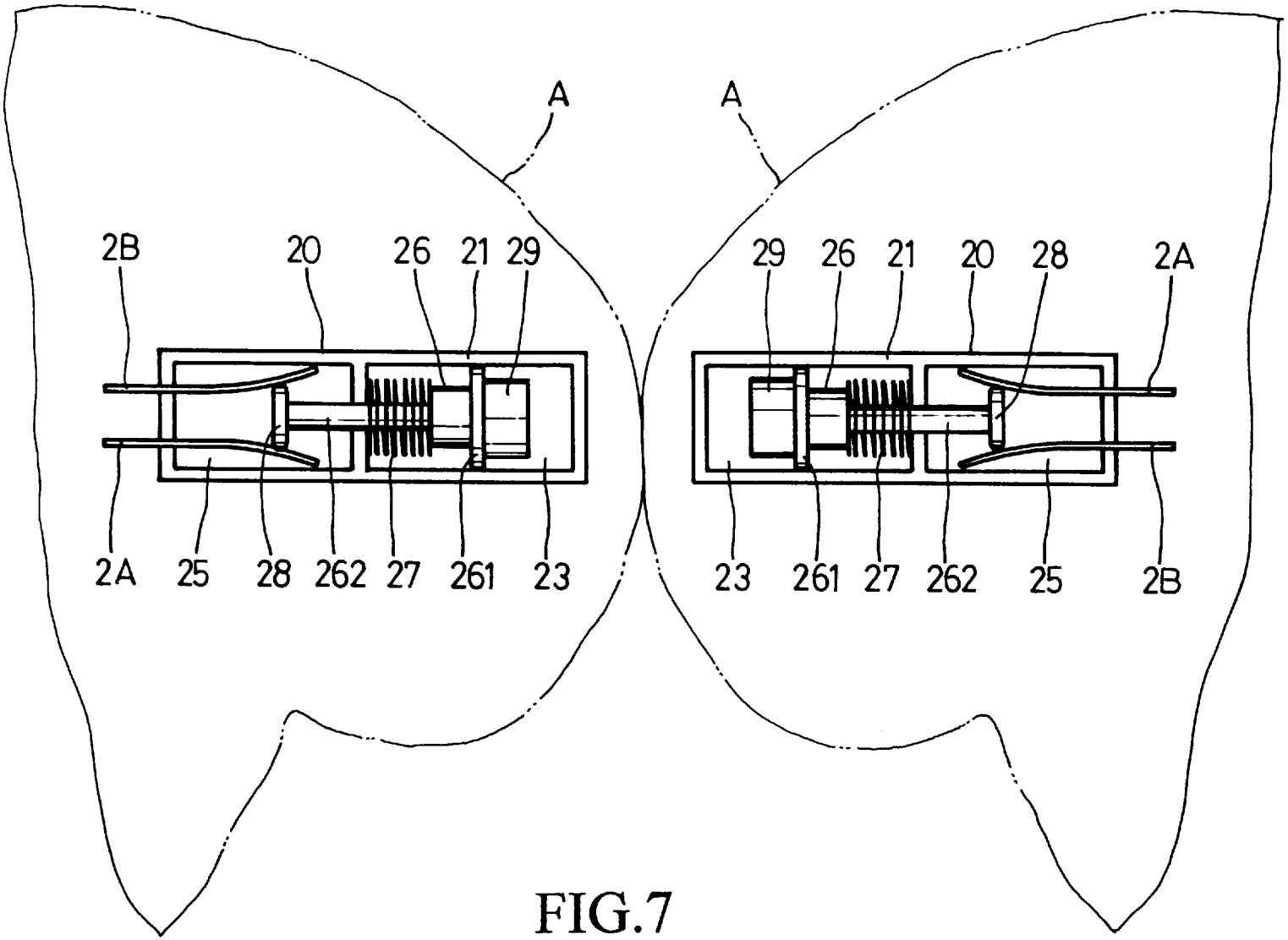
FIG. 7 is a cross-sectional view of the second embodiment of a switch device turned on in the present invention.

As to the function of the second embodiment, as shown in FIG. 7, if the two contactors 20 are moved nearer each other to a preset position, the repelling force of the same poles of the two magnets 29 push the movable members 26 rearward against the coil springs 27, forcing the disc conductor 28 to contact the two strip conductors 2A, 2B to turn on the contactor 20.

Figure 8:
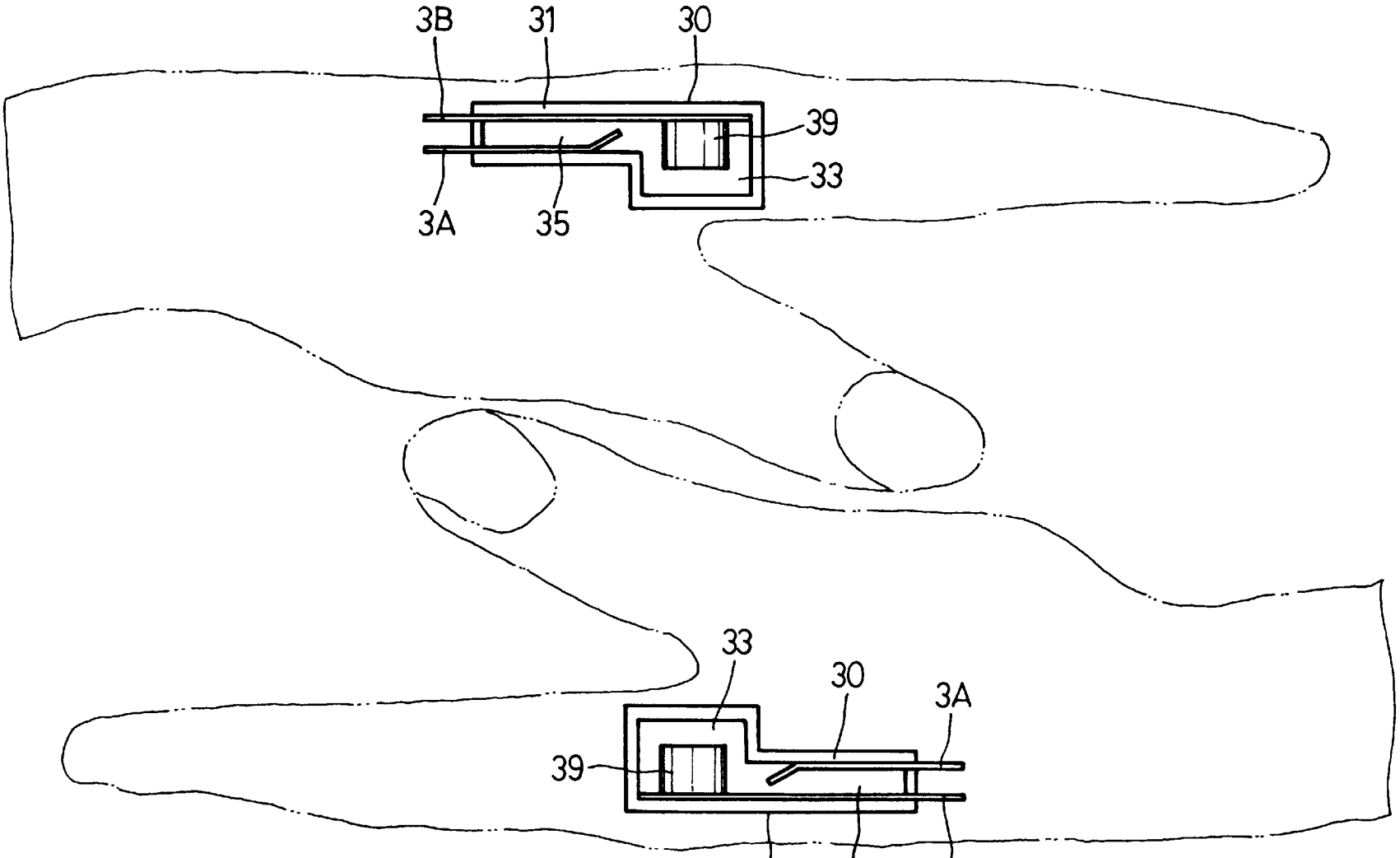
FIG. 8 is a cross-sectional view of a third embodiment of a switch device of the present invention.

The contactors 10, 20 in the first and the second embodiments are turned on by axial movement of the movable members 16, 26. But practically the invention is not limited to axial movement to effectuate a turning on action. A third embodiment of a switch device shown in FIGS. 8 and 9 includes a housing 31 of a non-cylindrical shape, but having a large space portion 33 and a small space portion 35 continually formed together. Further, the switch device of the third embodiment includes a pair of strip conductors 3A, 3B extending firmly inside the smaller space portion 35 on two side walls and having outer ends extending out of the housing 31. One strip conductor 3A has its inner end bent near the other strip conductor 3B, which extends into the large space 33 and is fixed firmly to a magnet 39.

Figure 9:
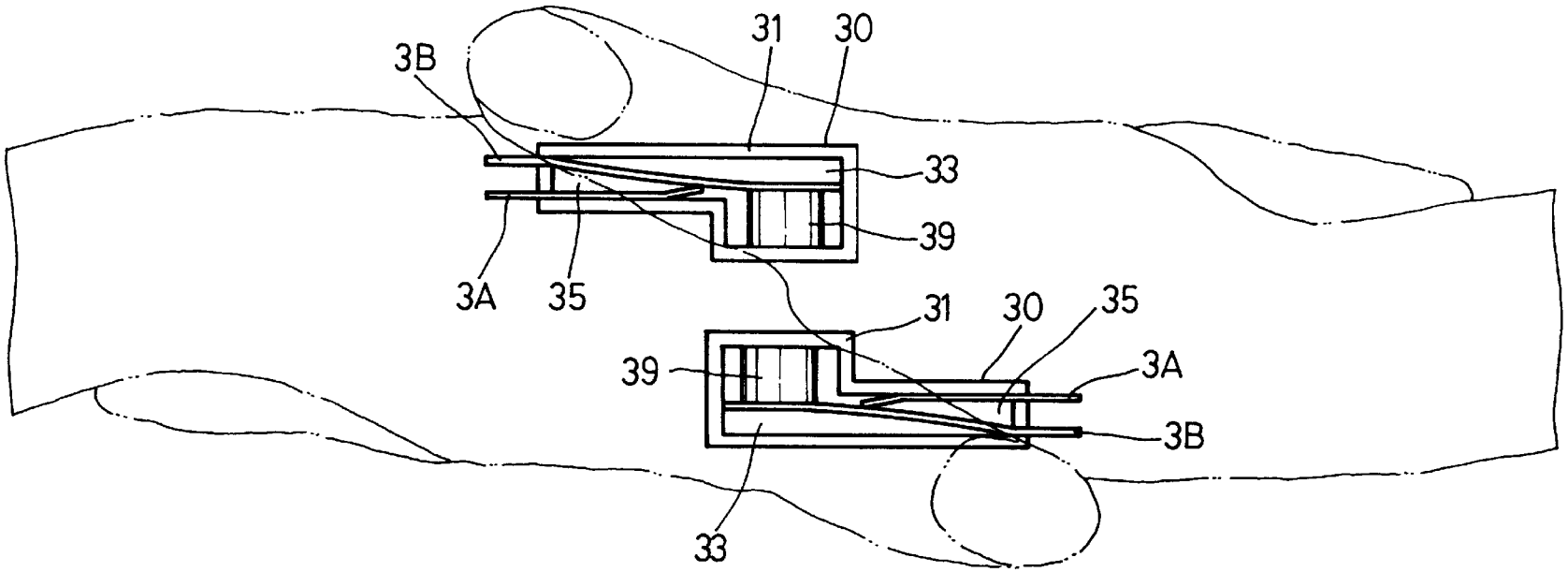
FIG. 9 is a cross-sectional view of the third embodiment of a switch device turned on in the present invention.

In using the third embodiment of a switch device, as shown in FIG. 9, the two large space portions 33 of the two (contactors 30 are moved nearer each other, permitting the two magnets 39 of both the contactors 30 to attract each other with the same poles, forcing the strip conductors 3B to bend forward to contact the other strip conductors 3A, turning on the contactors 30. As the strip conductors 3A, 3B are all elastic, the conductors 3B may recover its elasticity to bounce back to its normal position the two strip conductors 3A, 3B being in off condition after the two contactors 30 are separated away from each other.

Figure 10:
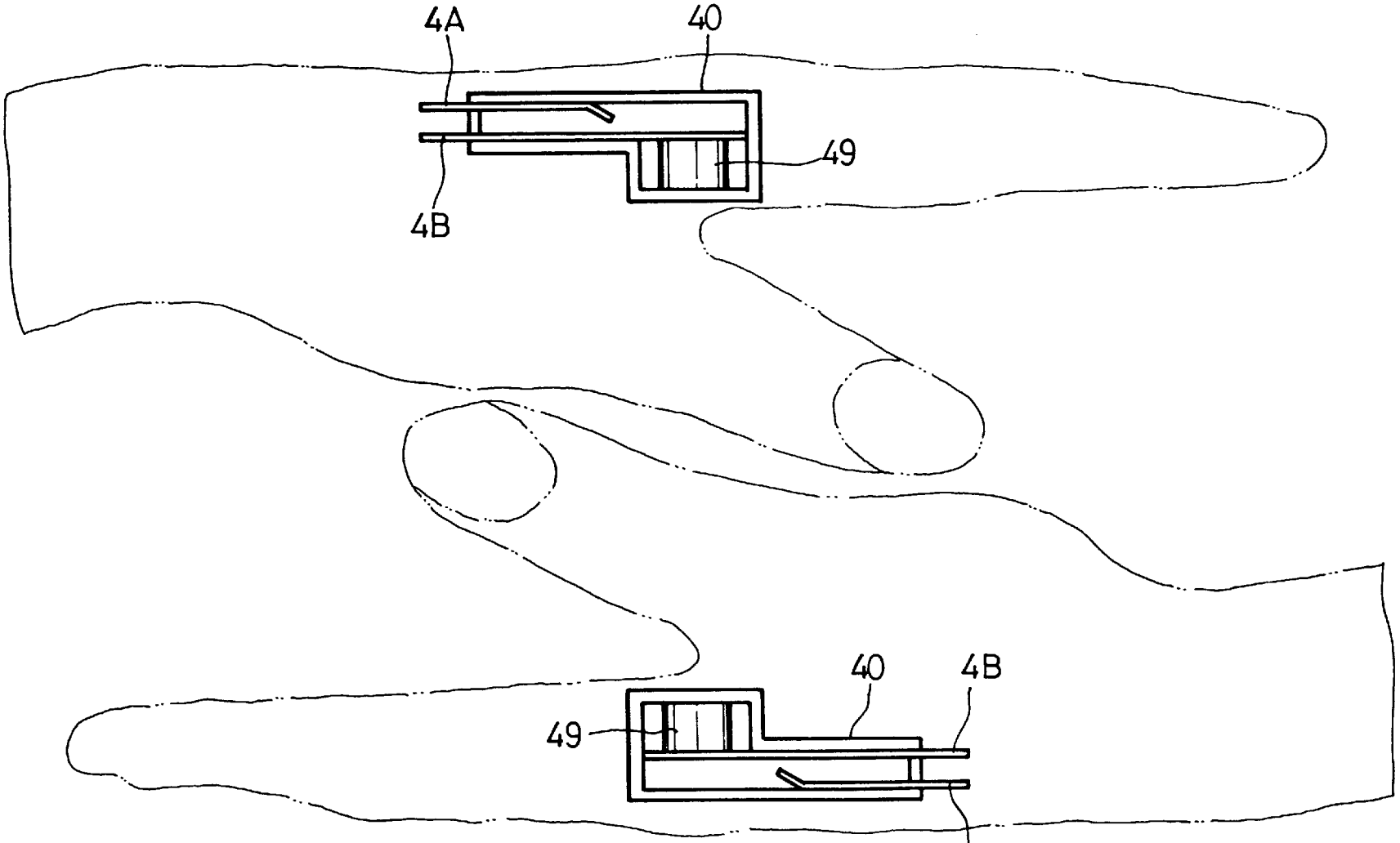
FIG. 10 is a cross-sectional view of a fourth embodiment of a switch device of the present invention.
Figure 11:
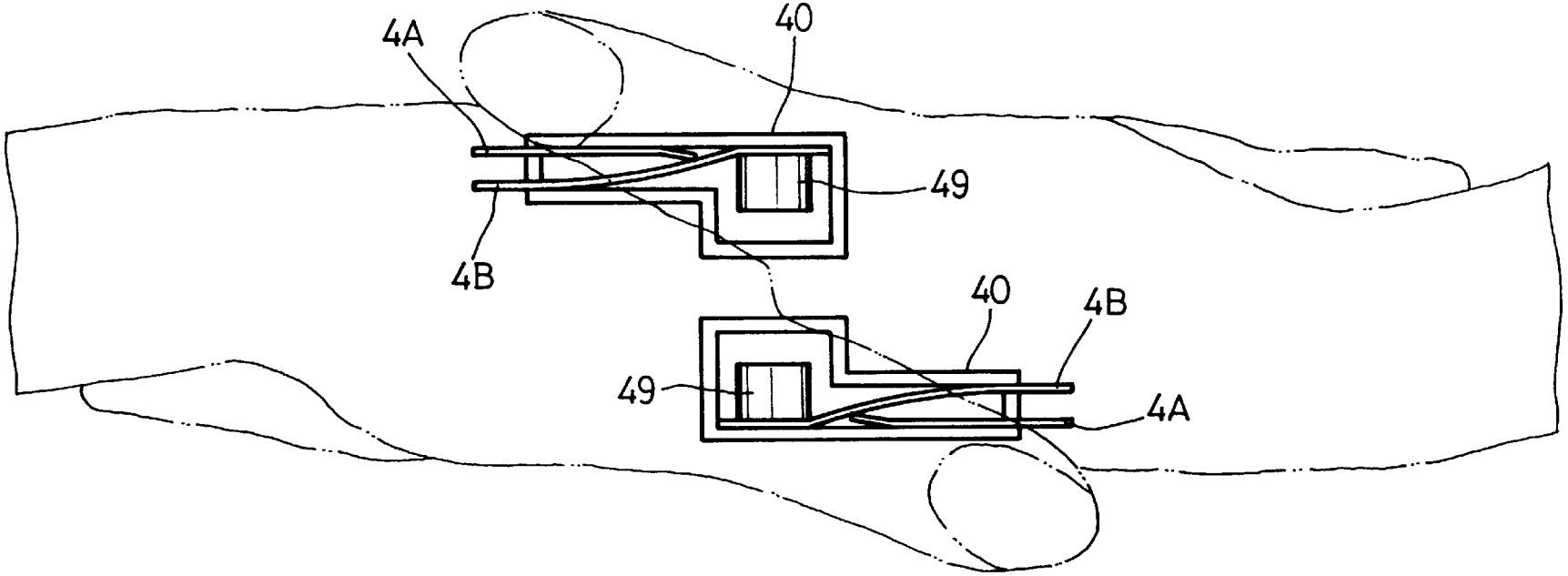
FIG. 11 is a cross-sectional view of the fourth embodiment of a switch device turned on in the present invention.

Further, a fourth embodiment of a switch device is shown in FIGS. 10 and 11, having the same structure as the third embodiment, except that the two strip conductors 4A, 4B are located nearer each other, with the two poles of the two magnets 49 being the same to repel each other rather than to attract each other as in the third embodiment, forcing the strip conductor 4A to bend to contact the other strip conductor 4B. It goes without saying that the strip conductors 4A, 4B are all elastic.

Figure 12:
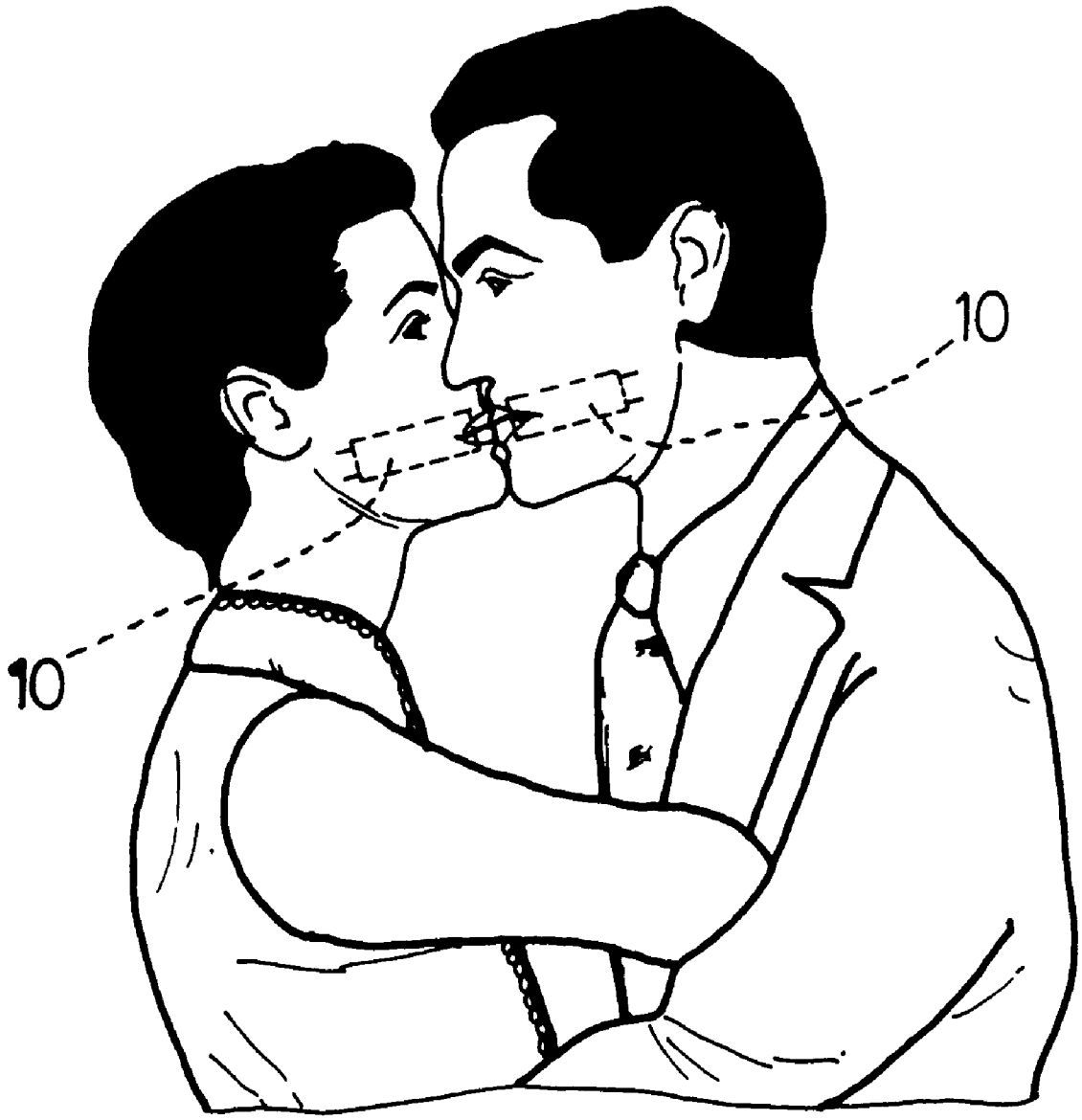
FIG. 12 is a perspective view of the first embodiment of a switch device applied to a thing in the present invention; and, FIG. 13 is a cross-sectional view of a fifth embodiment of a switch device of the present invention.

The structure of the first and the second embodiment which uses axial movement in turning on the contactors is preferably applied to boxing dolls shown in FIG. 1. In addition, it can also be applied to a male and a female doll performing a kiss as shown in FIG. 12, wherein the contactors are provided at the lips so that the contactors are turned on and sound out talking when the two dolls move near to kiss each other. The third and the fourth embodiment can be applied to glove-shaped toys shown in FIGS. 9 and 11. When the two glove-shaped toys move nearer each other, the contactors hidden inside can be turned on to move them and let them talk.

Figure 13:
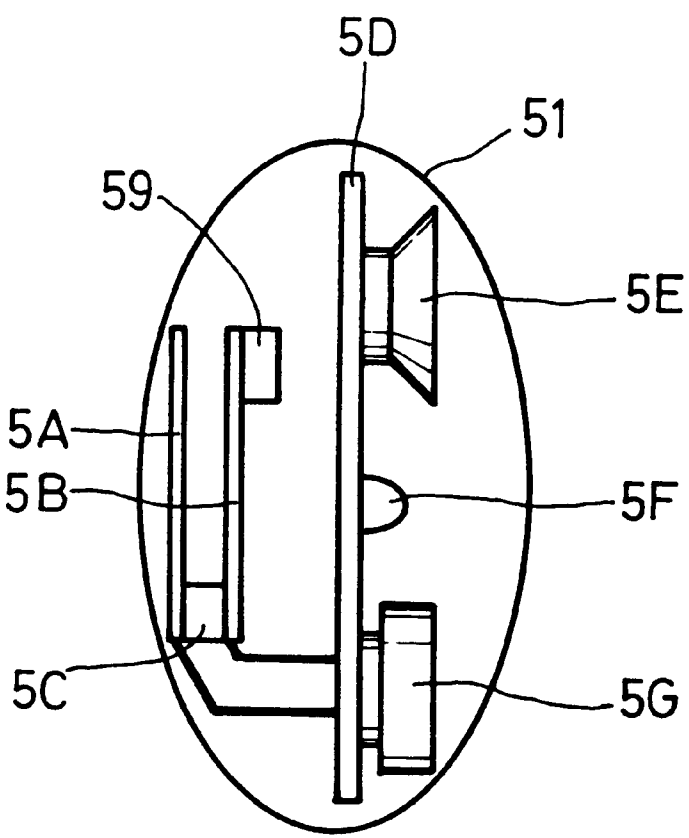
Figure 13:
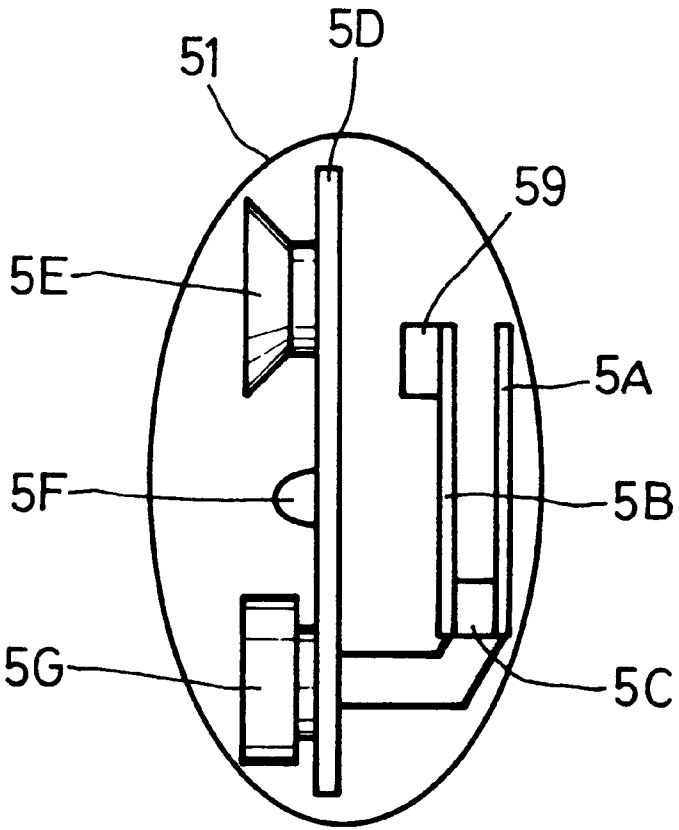

Those embodiments of the first to the fourth are all hidden in something such as dolls, boxing gloves, etc., but they can be installed in other ways, as shown in a fifth embodiment illustrated in FIG. 13. The fifth embodiment includes a housing 51, two strip conductors 5A, 5B contained in one side in the housing 51, an insulating member 5C located between the two conductors 5A, 5B, and a magnet 59 fixed on an outer end of the conductor 5B which is made of an elastic material. Further, a circuit board 5D is provided in another side in the housing 51, and a loud speaker 5E, an IC 5F and a power source 5G are positioned on the circuit board 5D. All the components are contained in the housing, as the conductors 5A, 5B are connected to the circuit board 5D. The two conductors 5A, 5B, and the magnet 59 constitute a contactor as described above, and the circuit board 5D, the loud speaker 5E, the IC 5F and the power source 5F are not the components of the contactor, but rather than elements for the thing (such as a doll, a boxing glove, etc., and ) are only contained in the the same housing 51. When the two things move near each other, the two magnets 59 in the two things may attract each other to turn on the circuit. As a result the contactor is not necessarily hidden in a thing, nor does it need to have a housing, but can be designed to have a housing as a conductor. The various embodiments described above have the conductors always normally open to cope with the magnets mutually attractive or repellent so as to let them contact each other for turning on the switch device. In a practical appliance, conductors in a normally closed initial condition can also be used to let the contactors turn off by the magnets attracting or repelling each other so that the thing provided with the contactor may be controlled in its action. Of course, using attraction or repelling of the magnets is dependent on the electronic circuit used in the thing. In addition, the number of the conductors may not be limited to two, but may be more if needed.

In short, the present invention uses two contactors to constitute a switch device, and when the two contactors are moved near enough to a proper position, the magnets in the two contactors attract or repel each other to start corresponding movement of the two things having the contactors. The corresponding movement means that the two things have further movement after starting, and the separate movement of the two things may be related or not related to each other. i.e. may indepedently accomplish their own movement. Of course, their movement may be slow, quick, long or short, depending on design. Further, the movement of the things may include real dynamic action and static action (for example, starting two independent power sources or an electronic circuit being powered). The things are not limited, even simplified to have the contactor forming a large portion of a thing. The main movement and function of the present invention is effected by the two contactors constituting the switch device, which is turned on by means of the two contactors moving nearer each other to a preset position, and thereby activating two independent powers or an electronic circuit being powered for producing movement, and talking of the things.

While the preferred embodiments of the invention have been described above, it will be recognized and understood that various modifications may be made therein and the appended claims are intended to cover all such modifications which may fall within the spirit and scope of the invention.

I claim:

1. A switch device including two contactors, each said contactor comprising:

at least two conductors connected to a respective one of two electronic circuits, each of said circuits being in a respective object and each of said conductors having an open condition in which the two conductors are unconnected to each other and the two electronic circuits are open, and a closed condition in which said conductors are connected to each other and said two electronic circuits are closed;

at least two magnets respectively connected to said at least two conductors;

respective springs respectively located between said conductors and said magnets;

said at least two magnets being arranged to attract or repel each other so as to change an initial one of the conditions of said conductors into a different one of said conditions of said conductors when said two contactors move closer than a preset distance from each other, said spring forcing said conductors to move back to said initial one of said conditions after said contactors move farther than said preset distance from each other, whereby movement of said contactors simultaneously opens and closes said two electronic circuits respective said objects.

2. The switch device as claimed in claim 1, wherein each said contactor has a movable member oriented in an axial direction, and said movable member has a front end firmly fixed to one of said magnets and a rear end fixed to a disc conductor, said disc conductor being located near said at least two conductors, said movable member being normally located at an original position to which it is biased by said spring, wherein said spring is a coil spring, said magnets of said at least two contactors causing said movable members to move synchronously so that said disc conductors and said two conductors may be moved relative to each other to change a condition of said conductors into said different one of said conditions if said magnets of said two conductors are moved close enough to each other to interact magnetically, said coil spring forcing said movable member and said disc conductor to move back to the original position so that said two conductors recover their initial one of said conditions when said two contactors move farther away from each other and said magnets cease to interact magnetically.

3. The switch device as claimed in claim 1, wherein said contactor has a housing, and said two conductors are strip conductors pinched in a wall of said housing, one of said strip conductors having its inner end fixed firmly with one of said magnets, said strip conductors being elastic, one of said two strip conductors being in an original position relative to the other of said two strip conductors, said one of said strip conductors being bent to move it from the original position into a temporary position relative to the other of said strip conductors when said two contactors move non-axially nearer to each other and permit said two magnets interact magnetically, said bent strip conductor recovering its original position when said two contactors move farther away from each other and said two magnets cease to interact magnetically.

* * * * *